US007523032B2

(12) United States Patent
Heikkinen et al.

(10) Patent No.: US 7,523,032 B2
(45) Date of Patent: Apr. 21, 2009

(54) SPEECH CODING METHOD, DEVICE, CODING MODULE, SYSTEM AND SOFTWARE PROGRAM PRODUCT FOR PRE-PROCESSING THE PHASE STRUCTURE OF A TO BE ENCODED SPEECH SIGNAL TO MATCH THE PHASE STRUCTURE OF THE DECODED SIGNAL

(75) Inventors: Ari Heikkinen, Tampere (FI); Sakari Himanen, Tampere (FI); Anssi Rämö, Tampere (FI)

(73) Assignee: Nokia Corporation, Espoo (FI)

( * ) Notice: Subject to any disclaimer, the term of this patent is extended or adjusted under 35 U.S.C. 154(b) by 1026 days.

(21) Appl. No.: 10/742,645

(22) Filed: Dec. 19, 2003

(65) Prior Publication Data

US 2005/0137858 A1 Jun. 23, 2005

(51) Int. Cl.
*G10L 11/04* (2006.01)
*G10L 19/10* (2006.01)
*G10L 19/04* (2006.01)

(52) U.S. Cl. ..... 704/207; 704/219; 704/220

(58) Field of Classification Search ..... 704/207, 704/219, 220

See application file for complete search history.

(56) References Cited

U.S. PATENT DOCUMENTS 5,596,675 A * 1/1997 Ishii et al. ..... 704/211
5,848,387 A * 12/1998 Nishiguchi et al. ..... 704/214
5,926,788 A * 7/1999 Nishiguchi ..... 704/265
6,115,685 A * 9/2000 Inoue et al. ..... 704/205
6,161,089 A * 12/2000 Hardwick ..... 704/230
6,233,550 B1 * 5/2001 Gersho et al. ..... 704/208
6,292,777 B1 * 9/2001 Inoue et al. ..... 704/230
2001/0023396 A1 9/2001 Gersho et al.
2002/0184009 A1 12/2002 Heikkinen

FOREIGN PATENT DOCUMENTS

WO 03090209 10/2003

OTHER PUBLICATIONS

"Speech Analysis/Synthesis Based on a Sinusoidal Representation" by Robert J. McAulay, IEEE Transactions on Acoustics, Speech, and Signal Processing, vol. ASSP-34, No. 4, Aug. 1986.

"Robust Closed-Loop Pitch Estimation for Harmonic Coders by Time Scale Modification" by Chunyan Li et al, Proceedings of IEEE International Conference on Acoustics, Speech, and Signal Processing, 1999, pp. 257-260.

(Continued)

*Primary Examiner*—Talivaldis Ivars Smits

(57) ABSTRACT

The invention relates to a method for use in parametric speech coding. In order to enable an improved parametric coding of speech signals, the method comprises a first step of pre-processing a to be encoded speech based signal such that a phase structure of the to be encoded speech based signal is approached to a phase structure which is obtained when the to be encoded speech based signal is parametrically encoded and decoded again. Only in a second step, a parametric encoding is applied to this pre-processed to be encoded speech based signal. The invention relates equally to a corresponding device, to a corresponding coding module, to a corresponding system and to a corresponding software program product.

22 Claims, 6 Drawing Sheets

OTHER PUBLICATIONS

"Analysis-By-Synthesis Low-Rate Multimode Harmonic Speech Coding" by C. Li et al, 6th European Conference on Speech Communication and Technology, Eurospeech, vol. 3 of 6, Sep. 5, 1999, pp. 1451-1454.

Exploiting Time Warping in AMR-NB and AMR-WB Speech Coders, by L. Laaksonen et al, 8th European Conf. on Speech Communication and Technology, Eurospeech, Sep. 1, 2003, pp. 1729-1732.

"A Hybrid Coder Based on a New Phase Model for Synchronization Between Harmonic and Waveform Coded Segments" by N. Katugampala et al, Electronics Letters, IEE Stevenage, GB, vol. 2, May 2001 pp. 685-688.

"A 4 KB/S Hybrid MeLP/CELP Coder with Alignment Phase Encoding and Zero-Phase Equalization" by J. Stachurski et al, Acoustics, Speech, and Signal Processing, 2000, ICASSP '00, vol. 3, Jun. 5, 2000, pp. 1379-1382.

* cited by examiner

SPEECH CODING METHOD, DEVICE, CODING MODULE, SYSTEM AND SOFTWARE PROGRAM PRODUCT FOR PRE-PROCESSING THE PHASE STRUCTURE OF A TO BE ENCODED SPEECH SIGNAL TO MATCH THE PHASE STRUCTURE OF THE DECODED SIGNAL

FIELD OF THE INVENTION

The invention relates to a method for use in speech coding, to a device and a coding module for performing a speech coding, to a system comprising at least one such device, and to a software program product in which a software code for use in speech coding is stored.

BACKGROUND OF THE INVENTION

When speech based signals are to be transmitted via a radio interface or to be stored, they are usually first compressed by encoding in order to save spectral resources on the radio interface and storage capacity, respectively. The speech based signal has then to be decompressed again by decoding, before it can be presented to a user.

Speech coders can be classified in different ways. The most common classification of speech coders divides them into two main categories, namely waveform-matching coders and parametric coders. The latter are also referred to as source coders or vocoders. In either case, the data which is eventually to be stored or transmitted is quantized. The error induced by this quantization depends on the available bit-rate.

Waveform-matching coders try to preserve the waveform of the speech signal in the coding, without paying much attention to the characteristics of the speech signal. With a decreasing quantisation error, which can be achieved by increasing the bit-rate of the encoded speech signal, the reconstructed signal converges towards the original speech signal. In document TIA/EIA/IS-127, "Enhanced variable rate codec, speech service option 3 for wideband spread spectrum digital systems", Telecommunications Industry Association Draft Document, February 1996, a modification of the pitch structure of an original speech signal is proposed for waveform coding, and more precisely for a code excited linear prediction (CELP), in order to improve the efficiency of long-term prediction.

Parametric speech coders, in contrast, describe speech with the help of parameters indicative of the spectral properties of the speech signal. They use a priori information about the speech signal via different speech coding models and try to preserve the perceptually most important characteristics of the speech signal by means of the parameters, rather than to code its actual waveform. The perfect reconstruction property of waveform coders is not given in the case of parametric coders. That is, in conventional parametric coders the reconstruction error does not converge to zero with a decreasing quantisation error. This deficiency may prevent a high quality of the coded speech for a variety of speech signals.

Parametric coders are typically used at low and medium bit rates of 1 to 6 kbit/s, whereas waveform-matching coders are used at higher bit rates. A typical parametric coder has been described by R. J. McAulay and T. F. Quatieri in: "Sinusoidal coding", Speech Coding and Synthesis, Editors W. B. Kleijn and K. K. Paliwal, pp. 121-174, Elsevier Science B. V., 1995.

Parametric coding can further be divided into open-loop coding and closed-loop coding. In open-loop coding, an analysis is performed at the encoding side to obtain the necessary parameter values. At the decoding side, the speech signal is then synthesized according to the results of the analysis. This approach is also called synthesis-by-analysis (SbA) coding. In closed-loop coding, and similarly in analysis-by-synthesis (AbS) coding, the parameters which are to be transmitted or stored are determined by minimizing a selected distortion criterion between the original speech signal and the reconstructed speech signal when using different parameter values.

Typically, parametric coders employ open-loop techniques. If an open-loop approach is used for parameter analysis and quantisation, however, the coded speech does not preserve the original speech waveform. This is true for all parameters, including amplitudes and voicing information.

In most parametric speech coders, the original speech signal or, alternatively, the vocal tract excitation signal is represented by a sinusoidal model s(t) using a sum of sine waves of arbitrary amplitudes, frequencies and phases, as presented for example in the above cited document "Sinusoidal coding" and by A. Heikkinen in: "Development of a 4 kbps hybrid sinusoidal/CELP speech coder", Doctoral Dissertation, Tampere University of Technology, June 2002:

$$s(t) = \mathrm{Re}\sum_{m=1}^{L(t)} a_m(t)\exp\left(j\left[\int_0^t \omega_m(\tau)\,d\tau + \theta_m\right]\right) \tag{1}$$

In the above equation, m represents the index of a respective sinusoidal component, L(t) represents the total number of sinusoidal components at a particular point of time t, $a_m(t)$ and $\omega_m(t)$ represent the amplitude and the frequency, respectively, for the mth sinusoidal component at a particular point of time t, and $\theta^m$ represents a fixed phase offset for the mth sinusoidal component. In case the vocal tract excitation signal is to be estimated instead of the original speech signal, this vocal tract excitation signal can be achieved by a linear prediction (LP) analysis, such that the vocal tract excitation signal constitutes the LP residual of the original speech signal. The term speech signal is to be understood to refer to either, the original speech signal or the LP residual.

To obtain a frame wise representation, all parameters are assumed to be constant over the analysis. Thus, the discrete signal s(n) in a given frame n is approximated by $$s(n) = \sum_{m=1}^{L} A_m \cos(n\omega_m + \theta_m), \tag{2}$$

where $A_m$ and $\theta_m$ represent the amplitude and the phase, respectively, of the mth sinusoidal component which is associated with the frequency track $\omega_m$. L represents again the total number of the considered sinusoidal components.

When proceeding from the presented sinusoidal model, simply the frequencies, amplitudes and phases of the found sinusoidal components could be transmitted as parameters for a respective frame. In practical low bit rate sinusoidal coders, though, the transmitted parameters include pitch and voicing, amplitude envelope, for example in form of LP coefficients and excitation amplitudes, and the energy of the speech signal.

In order to find the optimal sine-wave parameters for a frame, typically a heuristic method which is based on idealized conditions is used.

In such a method, overlapping low-pass analysis windows with variable or fixed lengths can be applied to the speech signal. A speech may comprise voiced speech, unvoiced speech, a mixture of both or silence. Voiced speech comprises those sounds that are produced when the vocal cords vibrate during the pronunciation of a phoneme, as in the case of vowels. In contrast, unvoiced speech does not entail the use of the vocal cords. For voiced speech, the window length should be at least two and one-half times the average pitch period to achieve the desired resolution.

Next, a high-resolution discrete Fourier transform (DFT) is taken from the windowed signal. To determine the frequency of each sinusoidal component, typically a simple peak picking of the DFT amplitude spectrum is used. The amplitude and phase of each sinusoid is then obtained by sampling the high-resolution DFT at these frequencies.

FIG. 1 presents for illustration in an upper diagram the amplitude of an exemplary LP residual over time in ms and in a lower diagram the amplitude of the LP residual in dB over the frequency in kHz.

In most parametric speech coders, also the voiced and unvoiced components of a speech segment are determined from the DFT of a windowed speech segment. Based on the degree of periodicity of this representation, different frequency bands can be classified as voiced or unvoiced. At lower bit rates, it is a common approach to define a cut-off frequency classifying all frequencies above the cut-off frequency as unvoiced and all frequencies below the cut-off frequency as voiced, as described for example in the above cited document "Sinusoidal coding".

In order to avoid discontinuities at the frame boundaries between successive frames and thus to achieve a smoothly evolving synthesized speech signal, moreover a proper interpolation of the parameters has to be used. For the amplitudes, a linear interpolation is widely used, while the evolving phase can be interpolated at high bit rates using a cubic polynomial between the parameter pairs in the succeeding frames, as described for example in the above cited documents "Sinusoidal coding" and "Development of a 4 kbps hybrid sinusoidal/CELP speech coder", and equally by R. J. McAulay and T. F. Quatieri in: "Speech analysis-synthesis based on a sinusoidal representation", IEEE Transactions on Acoustics, Speech, and Signal Processing, Vol. 34, No. 4, 1986, pp. 744-754, 1986. The interpolated frequency can be computed as a derivative of the phase function. Thus, the resulting model for the speech signal $\hat{s}(n)$ including the interpolations can be defined as $$\hat{s}(n) = \sum_{m=1}^{M} \hat{A}_m(n)\cos(\hat{\theta}_m(n)), \tag{3}$$

where $\hat{A}_m(n)$ represent the interpolated amplitude contour and $\hat{\theta}_m(n)$ the interpolated phase contour for a respective speech sample having an index n in the given frame. M represents the total number of sinusoidal components after the interpolation.

A linear interpolation of the amplitudes, however, is not optimal in all cases, for example for transients at which the signal energy changes abruptly. It is moreover a disadvantage that the interpolation is not taken into account in the parameter optimisation.

At low bit rates, it is further a typical assumption that the sinusoids at the multiples of the fundamental frequency $\omega_0$ are harmonically related to each other, which allows a further reduction in the amount of data which is to be transmitted or stored. In the case of voiced speech, the frequency $\omega_0$ corresponds to the pitch of the speaker, while in case of unvoiced speech, the frequency $\omega_0$ has no physical meaning. Furthermore, high-quality phase quantisation is difficult to achieve at moderate or even at high bit rates. Therefore, most parametric speech coders operating below 6 kbit/s use a combined linear/random phase model. A speech signal is divided into voiced and unvoiced components. The voiced component is modelled by the linear model, while the unvoiced component is modelled by the random component. The voiced phase model $\hat{\theta}(n)$ is defined by $$\hat{\theta}(n) = \theta^l + \omega^l n + (\omega^{l+1} - \omega^l)\frac{n^2}{2N}, \tag{4}$$

where l represents the frame index, n the sample index in the given frame and N the frame length. The phase model is thus defined to use the pitch values $\omega^l$ and $\omega^{l+1}$ for the previous and the current frame. These pitch values are usually the pitch values at the end of the respective frame. $\theta^l$ represents the value of the phase model at the end of the previous frame and constitutes thus some kind of a phase "memory". If the frequencies are harmonically related, the phase of the ith harmonic is simply i times the phase of the first harmonic, thus only data for the phase of the respective first harmonic has to be transmitted. The unvoiced component is generated with a random phase.

It is a disadvantage of the linear/random phase model, however, that the time synchrony between the original speech and the synthesized speech is lost. In the cubic phase interpolation, the synchrony is maintained only at the frame boundaries.

For a closed-loop parameter analysis, it has been proposed by C. Li, V. Cuperman and A. Gersho in: "Robust closed-loop pitch estimation for harmonic coders by time scale modification", Proceedings of IEEE International Conference on Acoustics, Speech, and Signal Processing, pp. 257-260, 1999, to modify the original speech signal to match the pitch contour derived for each set of pitch candidates. The best candidate is selected by evaluating the degree of matching between the modified signal and the synthetic signal generated with the pitch contour of that candidate. This method does not ensure a synchronization between the to be coded signal and the coded signal either, though.

A detailed analysis of the deficiencies of parametric coding is given in the above mentioned document "Development of a 4 kbps hybrid sinusoidal/CELP speech coder". FIG. 2 illustrates for an exemplary speech signal some of the problems which are related to conventional low bit rate parametric coding. FIG. 2 presents in an upper a diagram the amplitude of an original LP residual over time in ms. This LP residual was encoded using a sinusoidal coder employing the linear/random phase model and a frame size of 10 ms. FIG. 2 further presents in a lower diagram the amplitude of a reconstructed LP residual over time in ms.

First of all, the figure illustrates the time asynchrony between the original LP residual and the reconstructed signal. Moreover, the figure illustrates the poor behaviour of parametric coding during transients at the frame borders. More specifically, the first transients of the original LP residual segments are badly attenuated or masked by the noise component in the reconstructed LP residual. Finally, the figure shows the poor performance of a typical voiced/unvoiced classification resulting in a peaky nature of the reconstructed signal, that is, the pitch pulses of the reconstructed LP residual are very narrow and thus peaky due to the behaviour of the sinusoidal model. It is to be noted that these problems are also relevant in the underlying sinusoidal model without any quantisation.

For improving the coding of a speech signal, it has been proposed in US patent application 2002/0184009 A1 to normalize the pitch of an input signal to a fixed value prior to voicing determination in an analysis frame. This approach allows to minimize the effect of pitch jitter in voicing determination of sinusoidal speech coders during voiced speech. It does not result in a time-alignment between a speech signal and a reconstructed signal, though.

It is to be noted that problems due to a missing time-alignment between a speech signal and a reconstructed signal may be given as well with other types of speech coding than parametric speech coding.

SUMMARY OF THE INVENTION

It is an object of the invention to enable an improved a coding of speech signals.

A method for use in speech coding is proposed, which comprises pre-processing a to be encoded speech based signal. The pre-processing is performed such that a phase structure of the to be encoded speech based signal is approached to a phase structure which would be obtained if the to be encoded speech based signal was encoded and decoded. The proposed method further comprises applying an encoding to this pre-processed to be encoded speech based signal.

Moreover, a device and a coding module, respectively, for performing a speech coding are proposed, either comprising a pre-processing portion and a coding portion. The pre-processing portion is adapted to pre-process a to be encoded speech based signal such that a phase structure of the to be encoded speech based signal is approached to a phase structure which would be obtained if the to be encoded speech based signal was encoded and decoded. The coding portion is adapted to apply an encoding to a to be encoded speech based signal.

The proposed device can be any device offering at least an encoding of speech based signals. It can be for instance a mobile terminal or a network element of a radio communication network. The proposed coding module may provide the defined coding functionality to any device requiring such an encoding. To this end, it can either be integrated into a device or be connected to a device.

Further, a system is proposed, which comprises one or more of the proposed devices.

Finally, a software program product is proposed, in which a software code for use in speech coding is stored. The proposed software code realizes the steps of the proposed method when running in a processing unit, for instance in a processing unit of the proposed device or the proposed coding module.

The speech coding in the proposed method, the proposed device, the proposed coding module, the proposed system and the proposed software program product can be in particular, though not exclusively, a parametric speech coding employing at least one parameter indicative of the phase of a to be encoded speech based signal.

The invention proceeds from the consideration that the time synchrony between an encoded signal and an underlying speech based signal can be improved by pre-processing the to be encoded speech based signal before encoding and that such a pre-processed can be carried out in a way that the pre-processed speech signal is subjectively indistinguishable from the original signal. It is proposed to this end that the phase structure of the to be encoded speech based signal is modified to match to that of the decoded signal.

It is an advantage of the invention that it improves the synchrony between coded and original speech based signals and thereby the performance of, for example, a parametric speech coding. Based on the invention, most of the deficiencies of conventional parametric coding can be avoided and the quantisation error between a to be encoded speech based signal and a corresponding encoded signal decreases to zero with an increasing bitrate.

In case of a parametric encoding, the parameter estimation and quantisation, for example for the amplitude, can be carried out by minimizing an error criterion between the synthesized speech signal and the pre-processed speech based signal instead of the original speech based signal. The time synchrony also enables a time domain weighting of the error criterion.

In case of a parametric encoding, the invention allows as well to take the parameter interpolation into account in the quantisation process.

The invention allows further to use and select different interpolation schemes to mimic the behavior of the to be encoded speech based signal. This is beneficial, for instance, during transient speech segments where the energy contour is typically changing rapidly. In speech segments simultaneously containing voiced and unvoiced components, these components can be generated to mimic the time domain behavior of speech.

It is a general advantage of the invention, that, compared to prior art approaches, no additional information has to be transmitted to the decoding side.

The to be encoded speech based signal can be in particular an original speech signal or an LP residual of an original speech signal.

In one embodiment of the invention, the to be encoded speech based signal is pre-processed and encoded on a frame-by-frame basis.

In a further embodiment of the invention, the pre-processing comprises modifying a respective frame of the to be encoded speech based signal such that a phase contour of the pre-processed to be encoded speech based signal over the frame corresponds basically to a synthetic phase contour determined from pitch estimates for the to be encoded speech based signal. The amount of modification of the to be encoded speech based signal in the pre-processing is thus determined by the phase contour of the to be encoded signal and a synthetic phase contour. That is, in contrast to conventional approaches, the phase contour is generated not only at the decoding side, but equally at the encoding side.

A frame of a to be encoded speech based signal can be modified for example by estimating first a pitch for this frame. Based on this pitch estimate and a corresponding pitch estimate for a preceding frame, a synthetic phase contour over the frame can then be determined. On the one hand, the pitch pulse positions in this synthetic phase contour are determined. On the other hand, the pitch pulse positions in the frame of the to be encoded speech based signal are determined. The to be encoded speech based signal is then modified in the frame such that the positions of its pitch pulses are shifted to the positions of the pitch pulses of the synthetic phase contour.

In one embodiment of the invention, the pitch pulses in the to be encoded speech based signal are located by means of a signal energy contour.

The phase structure of a speech based signal can be modified in various ways.

In one embodiment of the invention, a time warping method is used for the modification of the phase structure. In the context of this invention, time warping refers to any modification of a signal segment in such a way that its length is either shortened or lengthened in time. A number of well known speech processing applications make use of time warping of a speech signal, including for instance shortening the duration of original speech messages in answering machines. Any such known time-warping method can be employed for the modification according to the invention.

For high-quality time warping, a number of algorithms have been proposed, many of them relying on an overlap-add principle either in the speech domain or in the LP residual domain, as presented for instance by E. Moulines and W. Verhelst in: "Time-domain and frequency-domain techniques for prosodic modification of speech", Speech Coding and Synthesis, Editors W. B. Kleijn and K. K. Paliwal, pp. 519-556, Elsevier Science B. V., 1995. Moreover, a time-warping method for an enhanced variable rate coder (EVRC) has been described in the above cited document "Enhanced variable rate codec, speech service option 3 for wideband spread spectrum digital systems". In this method, parts of an LP residual are either omitted or repeated to obtain the desired time warp. The time-warped LP residual is then obtained by filtering the modified residual through an LP synthesis filter. During voiced speech, omitting or repeating speech samples is advantageously carried out during low-energy portions of the signal, in order to avoid quality degradations in the modified LP residual.

For frames of a to be encoded speech based signal in which no reliable pitch pulse position is found, a conventional parametric coding of the to be encoded signal can be employed.

The pre-processed to be encoded speech based signal can be encoded in particular by an open-loop parametric coding or by a closed-loop parametric coding. When combining the proposed pre-processing and a closed-loop parametric coding, the deficiencies of the open-loop parametric coding can be avoided.

The pre-processing and the encoding can be realized by hardware and/or software.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
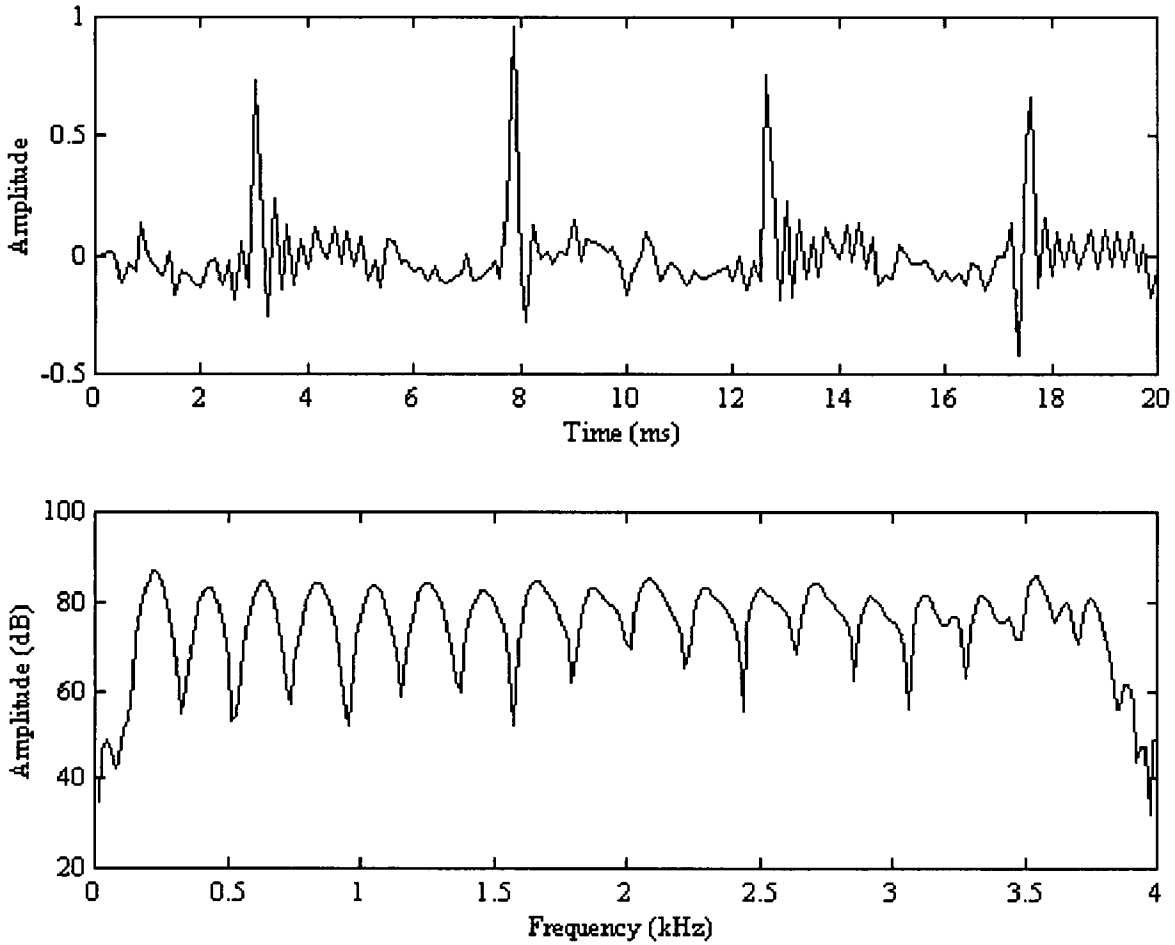
FIG. 1 presents the amplitude of an LP residual and its amplitude spectrum.
Figure 2:
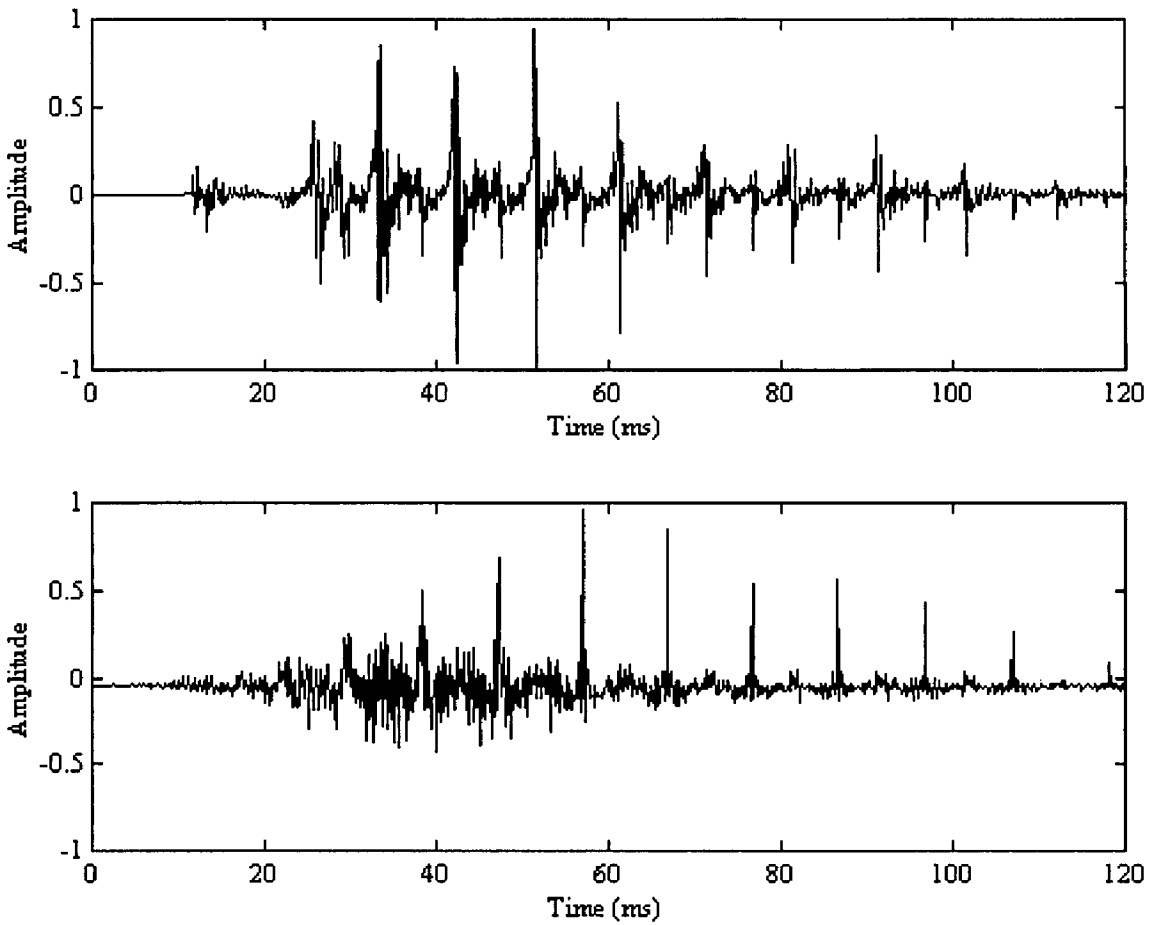
FIG. 2 presents the amplitude of an LP residual and a reconstructed signal amplitude resulting when using a conventional parametric coding.
Figure 3:
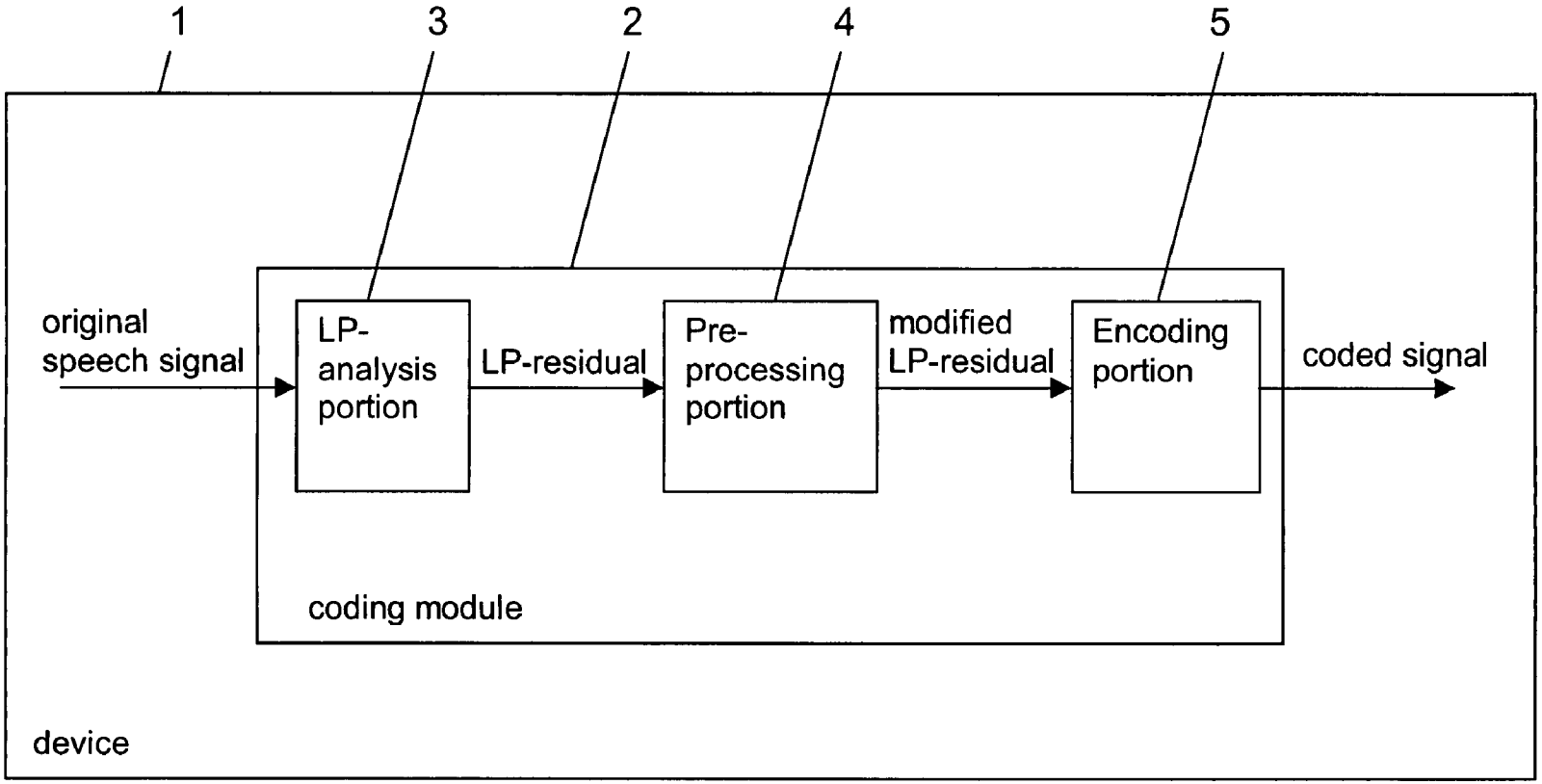
FIG. 3 is a schematic block diagram of an embodiment of a device according to the invention.

FIG. 3 is a schematic block diagram of an embodiment of a device 1 according to the invention. The device 1 can be any kind of device in which a speech signal is to be encoded. It can be, for example, a mobile phone or a network element in which a speech signal is to be encoded for transmission, or some device in which a speech signal is to be encoded for storage. The device 1 may be part of a system comprising at least said device but which may also comprise other devices, network elements, etc., which e.g., provide the original speech signal, receive the coded signal, or both.

The device 1 comprises by way of example a separate coding module 2, in which the invention is implemented. The coding module 2 includes an LP analysis portion 3, which is connected via a pre-processing portion 4 to an encoding portion 5. The portions 3, 4, 5 of the coding module 2 may be realized in hardware, in software, or in both.

Figure 4:
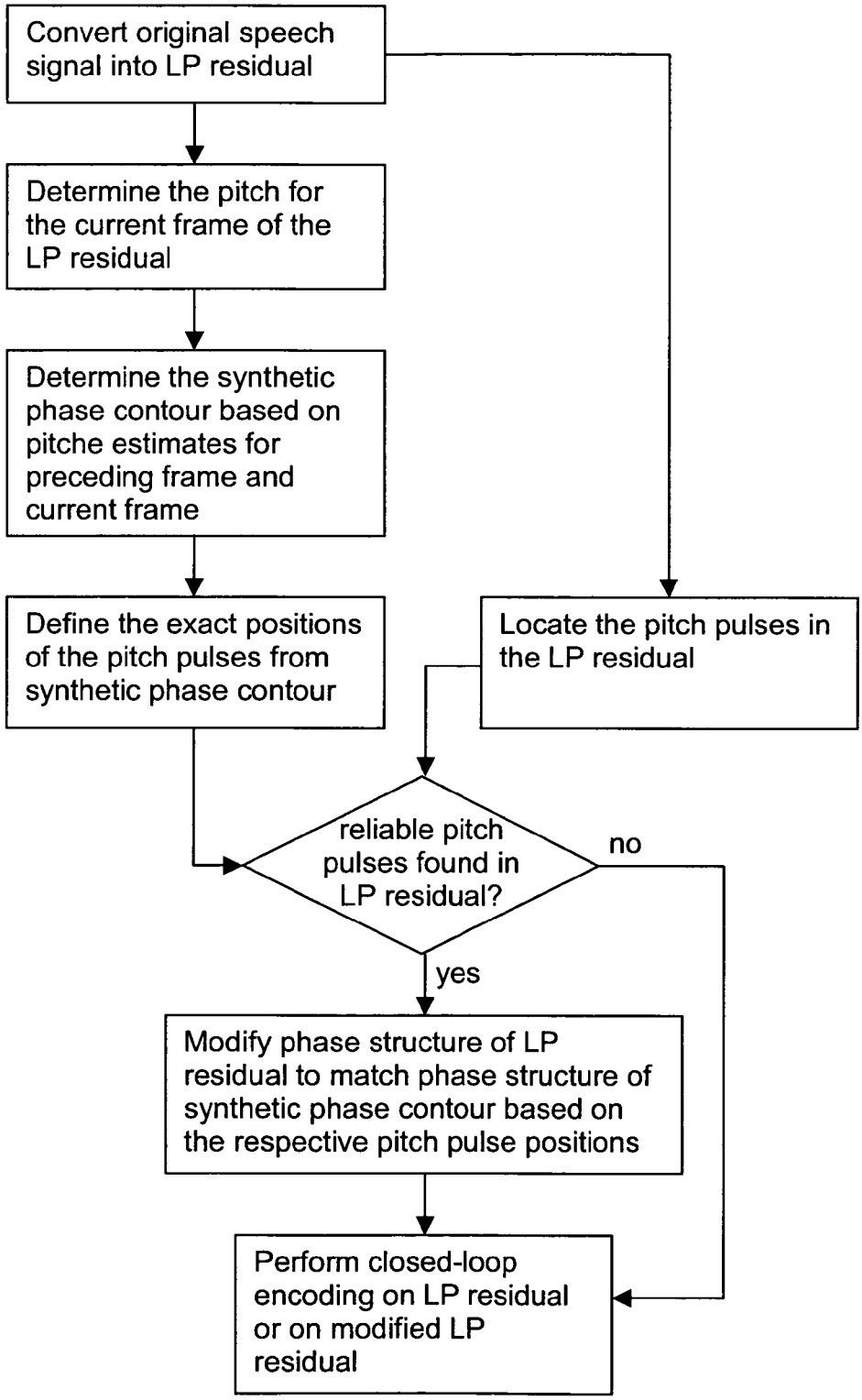
FIG. 4 is a flow chart illustrating the operation of the device of FIG. 3.

The encoding of an original speech signal in the device 1 of FIG. 3 will now be explained with reference to the flow chart of FIG. 4.

Figure 5:
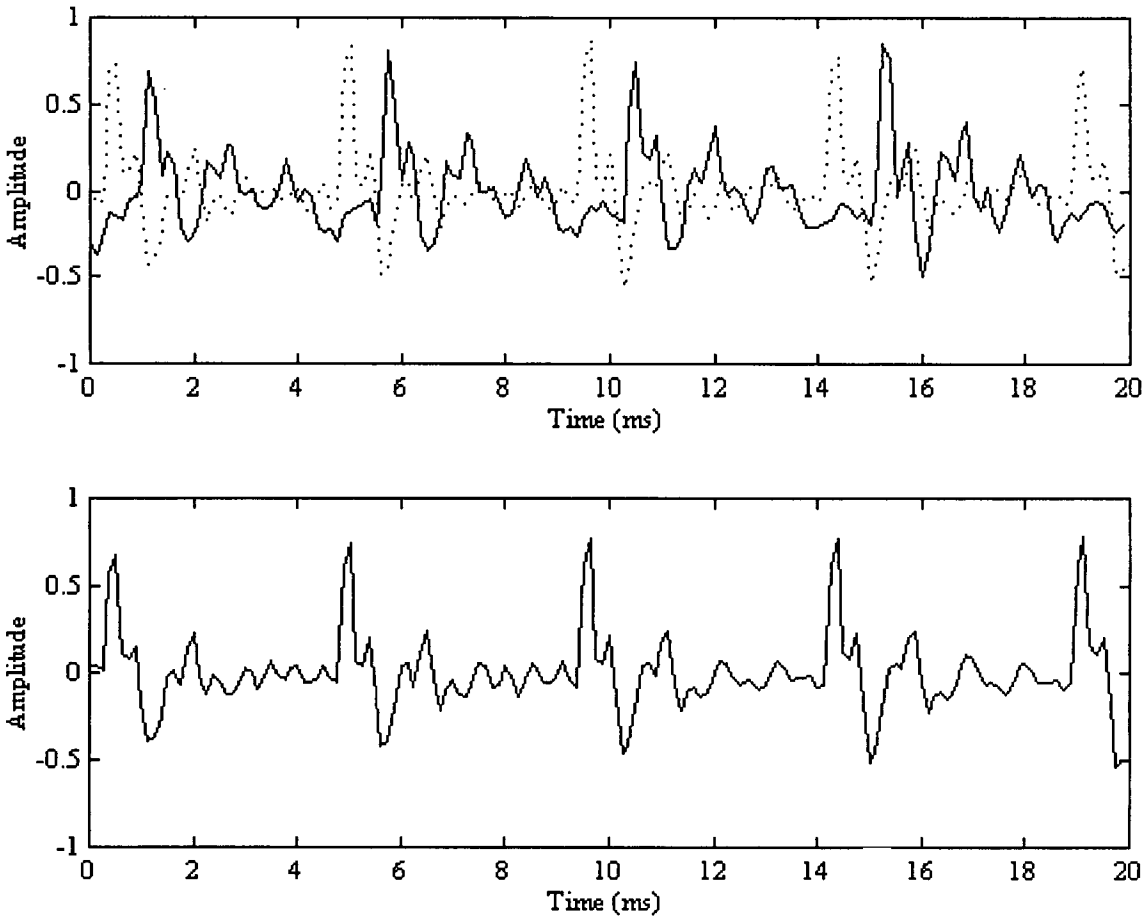
FIG. 5 illustrates an LP residual, an LP residual modified according to the invention and a reconstructed signal resulting when using a parametric coding in accordance with the invention.

An original speech signal which is available in the device 1 and which is to be encoded for compression is fed to the coding module 2 and within the coding module 2 to the LP analysis portion 3. The LP analysis portion 3 converts the original speech signal into an LP residual, as well known from the state of the art. FIG. 5 presents in an upper diagram the amplitude of an exemplary resulting LP residual with a solid line over time in ms. The LP residual is then forwarded to the pre-processing portion 4.

In the pre-processing portion 4, the phase structure of the LP residual is modified on a frame-by-frame basis to match to the phase structure of the signal resulting in an encoding of the LP residual and a subsequent decoding. To this end, first the pitch of the speech in the current frame of the LP residual is determined. For the pitch determination, any known pitch detection algorithm resulting in sufficiently good pitch estimates can be employed.

Next, the synthetic phase contour over the current frame is determined. The synthetic phase contour $\hat{\theta}(n)$, where n is the sample index of the phase contour, is determined based on the pitch estimate $\omega^{l}$ for the previous frame and the pitch estimate $\omega^{l+1}$ for the current frame, as defined above in equation (4).

From this phase contour, the exact positions of the pitch pulses can be defined by locating the multiples of $2\pi$ in time. Since a harmonic sinusoidal model is used, the phase and thus the behavior of the reconstructed signal is explicitly defined by the phase model. This implies that a pitch pulse of the reconstructed signal is located at an index where the sinusoidal model generator function, here $\cos(\hat{\theta}(n))$, reaches its maximum. The maximum is reached when the value of the argument $\hat{\theta}(n)$ is, in angular frequency, $m*(2*\pi)$, where m is an integer, since $\cos(m*2*\pi)=1$.

Moreover, the pitch pulses in the LP residual are located. To locate the pitch pulses in the LP residual, a simple signal energy contour can be used, as described for example in the above cited document "Development of a 4 kbps hybrid sinusoidal/CELP speech coder". The signal energy contour can be computed, for example, by sliding an energy window with a length of five samples over the LP residual segment. Pitch pulses are then found by locating the maximum values of the signal energy contour with the spacing of the pitch value.

In segments of the LP residual in which no reliable pitch pulse positions can be found, for example in case of unvoiced speech, the LP residual is forwarded without pre-processing to the encoding portion 5 for a conventional closed-loop parametric encoding.

For all other segments, the phase structure of the LP residual is first modified in the pre-processing portion 4 to match the phase structure of the synthetic phase contour. The deviation of the pitch pulse positions determined based on the synthetic phase contour from the found pulse position in the LP residual defines the required amount of modification.

Figure 6:
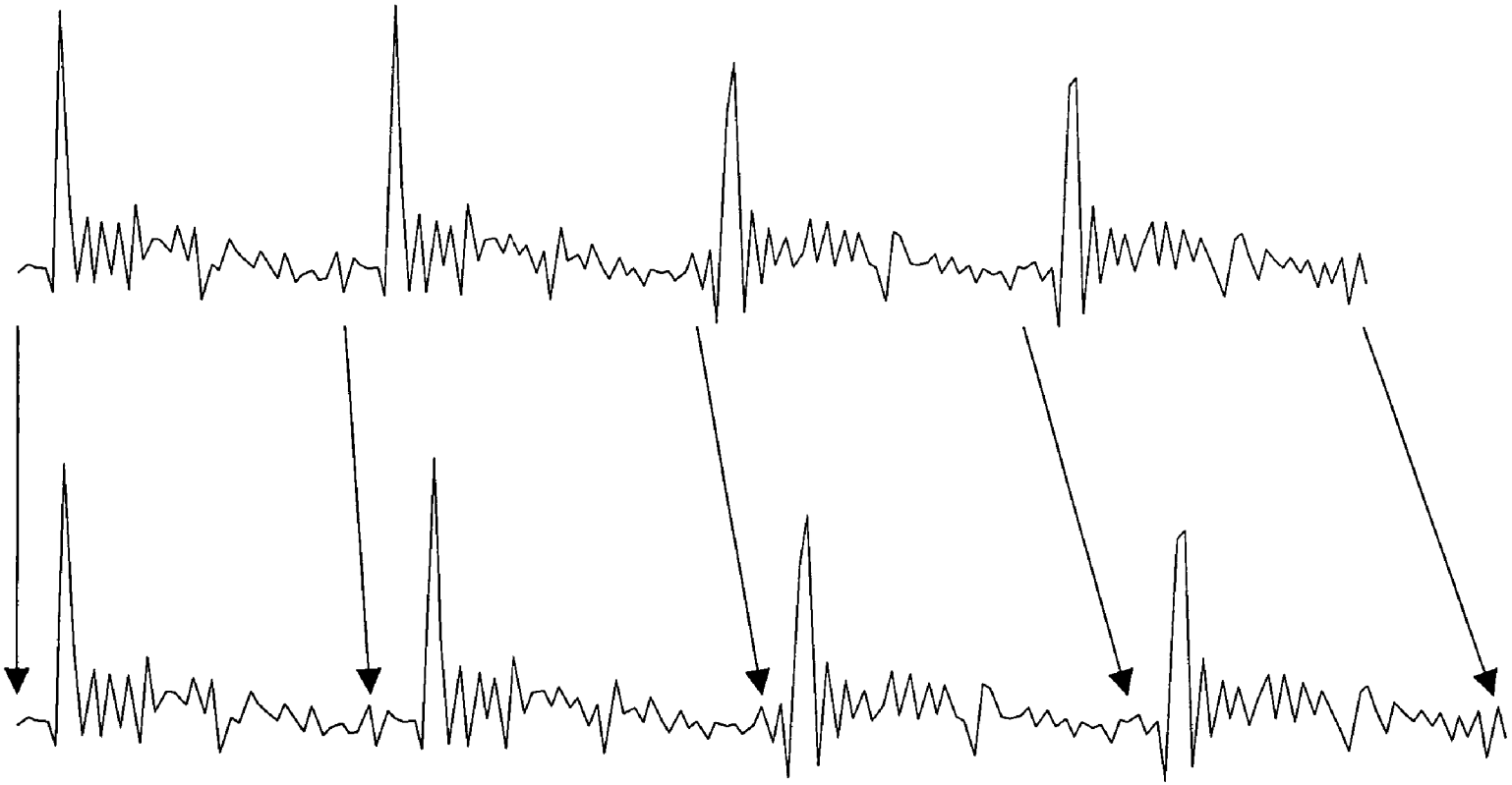
FIG. 6 illustrates the principle of time-warping.

For the modification of the phase structure of the LP residual, some known time warping method is used, for example the time-warping method for an EVRC described in the above cited document "Enhanced variable rate codec, speech service option 3 for wideband spread spectrum digital systems". The effect of such a modification in general is illustrated in FIG. 6. FIG. 6 presents in an upper diagram the amplitude of an original LP residual signal over time and in a lower diagram the amplitude of the same signal after time warping over time. Arrows indicate which pulses in the lower diagram originate from which pulses in the upper diagram. It can be seen that the length of the segments in the original signal is lengthened in the time warped signal. The length of the segments can also be shorten or stay unchanged, depending on the respectively required modification.

The amplitude of a modified LP residual which is based on the LP residual in the upper diagram of FIG. 5 is equally shown in the upper diagram of FIG. 5 over time in ms, but with dashed lines.

The modified LP residual is then provided by the pre-processing portion 4 to the encoding portion 5 for a conventional closed-loop parametric encoding, as described above with reference to equations (1) to (4). The modification ensures that the pre-processed LP residual signal which is encoded is aligned with the corresponding decoded signal.

The encoded signal provided by the encoding portion 5 is output by the coding module 2 for storage or transmission.

The amplitude of the decoded signal which is obtained by synthesis from the stored encoded signal or the transmitted encoded signal is shown in a lower diagram of FIG. 5 over time in ms. It can be seen that the modified LP residual in the upper diagram of FIG. 5 and the synthesized signals in the lower diagram of FIG. 5 are time-aligned.

The achieved time synchrony can be exploited in several ways for an improvement of the parametric coding, for instance in the scope of the amplitude analysis and/or quantisation, of the parameter interpolation, of the determination of voicing, of a time domain weighting of an error signal, etc.

While there have been shown and described and pointed out fundamental novel features of the invention as applied to a preferred embodiment thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for use in speech coding, said method comprising:

pre-processing a to be encoded speech based signal on a frame-by-frame basis such that a phase structure of said to be encoded speech based signal is approached to a phase structure which would be obtained if said to be encoded speech based signal was encoded and decoded; and applying an encoding to said pre-processed to be encoded speech based signal;

wherein pre-processing said to be encoded speech based signal comprises for a respective frame of said to be encoded speech signal:

estimating a pitch for said frame;

determining a synthetic phase contour over said frame based on said pitch estimate and a pitch estimate for a preceding frame;

locating at least one pitch pulse position in said determined synthetic phase contour;

locating at least one pitch pulse position in said frame of said to be encoded speech based signal; and modifying said to be encoded speech based signal in said frame such that the at least one pitch pulse position is shifted to the at least one pitch pulse position of said synthetic phase contour.

2. The method according to claim 1, wherein said speech coding is a parametric speech coding employing at least one parameter indicative of the phase of said to be encoded speech based signal.

3. The method according to claim 1, wherein said pre-processing comprises modifying a respective frame of said to be encoded speech based signal such that a phase contour of said pre-processed to be encoded speech based signal over said frame corresponds basically to a synthetic phase contour determined from pitch estimates for said to be encoded speech based signal.

4. The method according to claim 1, wherein said at least one pitch pulse in said to be encoded signal is located by means of a signal energy contour.

5. The method according to claim 1, wherein said to be encoded speech signal is modified by means of time warping.

6. The method according to claim 1, wherein for those frames of said to be encoded speech signal in which no reliable pitch pulse position is found, a coding without pre-processing of said to be encoded signal is employed.

7. The method according to claim 1, wherein said to be encoded speech based signal is one of an original speech signal and a linear prediction residual of an original speech signal.

8. The method according to claim 1, wherein said pre-processed to be encoded speech based signal is encoded by one of an open-loop parametric coding and a closed-loop parametric coding.

9. A device for performing a speech coding, said device comprising:

a pre-processing portion adapted to pre-process a to be encoded speech based signal on a frame-by-frame basis such that a phase structure of said to be encoded speech based signal is approached to a phase structure which would be obtained if said to be encoded speech based signal was encoded and decoded; and a coding portion which is adapted to apply an encoding to a to be encoded speech based signal;

wherein said pre-processing by said pre-processing portion comprises for a respective frame of a to be encoded speech signal:

estimating a pitch for said frame;

determining a synthetic phase contour over said frame based on said pitch estimate and a pitch estimate for a preceding frame;

locating at least one pitch pulse position in said determined synthetic phase contour;

locating at least one pitch pulse position in said frame of said to be encoded speech based signal; and modifying said to be encoded speech based signal in said frame such that the at least one pitch pulse position is shifted to the at least one pitch pulse position of said synthetic phase contour.

10. The device according to claim 9, wherein said coding portion applies a parametric speech coding to a to be encoded speech based signal employing at least one parameter indicative of the phase of said to be encoded speech based signal.

11. The device according to claim 9, wherein said pre-processing by said pre-processing portion comprises modifying a respective frame of a to be encoded speech based signal such that a phase contour of said pre-processed to be encoded speech based signal over said frame corresponds basically to a synthetic phase contour determined from pitch estimates for said to be encoded speech based signal.

12. The device according to claim 9, wherein said device is one of a mobile terminal and a network element.

13. A coding module for performing a speech coding, said coding module comprising:

a pre-processing portion adapted to pre-process a to be encoded speech based signal on a frame-by-frame basis such that a phase structure of said to be encoded speech based signal is approached to a phase structure which would be obtained if said to be encoded speech based signal was encoded and decoded; and a coding portion which is adapted to apply an encoding to a to be encoded speech based signal;

wherein said pre-processing by said pre-processing portion comprises for a respective frame of a to be encoded speech signal:

estimating a pitch for said frame;

determining a synthetic phase contour over said frame based on said pitch estimate and a pitch estimate for a preceding frame;

locating at least one pitch pulse position in said determined synthetic phase contour;

locating at least one pitch pulse position in said frame of said to be encoded speech based signal; and modifying said to be encoded speech based signal in said frame such that the at least one pitch pulse position is shifted to the at least one pitch pulse position of said synthetic phase contour.

14. The coding module according to claim 13, wherein said coding portion applies a parametric speech coding to a to be encoded speech based signal employing at least one parameter indicative of the phase of said to be encoded speech based signal.

15. The coding module according to claim 13, wherein said pre-processing by said pre-processing portion comprises modifying a respective frame of a to be encoded speech based signal such that a phase contour of said pre-processed to be encoded speech based signal over said frame corresponds basically to a synthetic phase contour determined from pitch estimates for said to be encoded speech based signal.

16. A system comprising at least one device for performing a speech coding, said at least one device comprising:

a pre-processing portion adapted to pre-process a to be encoded speech based signal on a frame-by-frame basis such that a phase structure of said to be encoded speech based signal is approached to a phase structure which would be obtained if said to be encoded speech based signal was encoded and decoded; and a coding portion which is adapted to apply an encoding to a to be encoded speech based signal;

wherein said pre-processing by said pre-processing portion of said at least one device comprises for a respective frame of a to be encoded speech signal:

estimating a pitch for said frame;

determining a synthetic phase contour over said frame based on said pitch estimate and a pitch estimate for a preceding frame;

locating at least one pitch pulse position in said determined synthetic phase contour;

locating at least one pitch pulse position in said frame of said to be encoded speech based signal; and modifying said to be encoded speech based signal in said frame such that the at least one pitch pulse position is shifted to the at least one pitch pulse position of said synthetic phase contour.

17. The system according to claim 16, wherein said coding portion of said at least one device applies a parametric speech coding to a to be encoded speech based signal employing at least one parameter indicative of the phase of said to be encoded speech based signal.

18. The system according to claim 16, wherein said pre-processing by said pre-processing portion of said at least one device comprises modifying a respective frame of a to be encoded speech based signal such that a phase contour of said pre-processed to be encoded speech based signal over said frame corresponds basically to a synthetic phase contour determined from pitch estimates for said to be encoded speech based signal.

19. The system according to claim 16, wherein said at least one device is at least one of a mobile terminal and a network element.

20. A coding module in which a software code for use in speech coding is stored, said software code realizing the following steps when running in a processing unit:

pre-processing a to be encoded speech based signal on a frame-by-frame basis such that a phase structure of said to be encoded speech based signal is approached to a phase structure which would be obtained if said to be encoded speech based signal was encoded and decoded; and applying an encoding to said pre-processed to be encoded speech based signal;

wherein pre-processing said to be encoded speech based signal comprises for a respective frame of said to be encoded speech signal:

estimating a pitch for said frame;

determining a synthetic phase contour over said frame based on said pitch estimate and a pitch estimate for a preceding frame;

locating at least one pitch pulse position in said determined synthetic phase contour;

locating at least one pitch pulse position in said frame of said to be encoded speech based signal; and modifying said to be encoded speech based signal in said frame such that the at least one pitch pulse position is shifted to the at least one pitch pulse position of said synthetic phase contour.

21. The coding module according to claim 20, wherein said speech coding is a parametric speech coding employing at least one parameter indicative of the phase of a to be encoded speech based signal.

22. The coding module according to claim 20, wherein said pre-processing comprises modifying a respective frame of said to be encoded speech based signal such that a phase contour of said pre-processed to be encoded speech based signal over said frame corresponds basically to a synthetic phase contour determined from pitch estimates for said to be encoded speech based signal.

* * * * *